US005492432A

United States Patent [19]

Eben et al.

[11] Patent Number: 5,492,432

[45] Date of Patent: Feb. 20, 1996

[54] CONCRETE VIBRATING MACHINE

[75] Inventors: Larry G. Eben; Jerry Chaon; Ewald R. Ulmer, all of Canton, S. Dak.

[73] Assignee: CMI Corporation, Canton, S. Dak.

[21] Appl. No.: 210,377

[22] Filed: Mar. 18, 1994

[51] Int. Cl.[6] ..... F01C 19/38

[52] U.S. Cl. ..... 404/115

[58] Field of Search ..... 404/102, 113, 404/114, 115, 116, 133.2

[56] References Cited

U.S. PATENT DOCUMENTS 4,256,415 3/1981 Rowe et al. ..... 404/116

4,320,987 3/1982 Rowe et al. ..... 404/115

*Primary Examiner*—William P. Neuder

*Attorney, Agent, or Firm*—Emrich & Dithmar

[57] ABSTRACT

A concrete vibrator apparatus is described for use in conjunction with a concrete finishing machine that is movable longitudinally along a roadway. The finishing machine includes a finishing unit engageable with the surface of the concrete and movable transversely across the roadway, a supporting frame mounted to and extending forwardly and outwardly from the movable finishing unit, and a vibrator assembly mounted to the supporting frame. The vibrator assembly includes first and second vibrator units, with each of the vibrator units being independently movable between a downwardly position wherein the vibrator unit extends into and below the surface of the concrete and an upwardly position wherein the vibrator unit is out of contact with the surface of the roadway. A control mechanism is described for controlling the selective movement of the vibrator units and the rate of vibration of the vibrator units.

11 Claims, 6 Drawing Sheets

CONCRETE VIBRATING MACHINE

BACKGROUND OF THE INVENTION

This invention relates to concrete vibrator machines which are particularly suited to be used in conjunction with concrete finishing machines for use on roadways, highways, streets and deep slab applications, such as airport runways and taxiways.

Concrete vibrator machines for use in vibrating concrete ahead of concrete finishing machines on highways and streets are well known in the art. See, for example, U.S. Pat. Nos. 2,255,344, 3,540,360 and 3,653,621. These patents generally disclose concrete vibrator machines wherein the vibrating apparatus is moved into and out of the concrete body in a substantially vertical or rearwardly extending direction from the machine thereby providing a limited amount of settling of the concrete. Such prior art vibrating assemblies have been generally displaced by concrete leveling machines which include hydraulic actuated vibrating apparatus mounted to the leveling carriage which is moved into and out of the concrete body as the carriage moves back and forth transversely of the roadway. See, for example, U.S. Pat. No. 4,320,987. Such vibrating apparatus is structured so that one of the vibrators always must be in contact with the body of the concrete. Accordingly, when it becomes necessary to clear obstacles, such as box-outs for manhole covers, runway lights or drainage openings, this type of vibrating apparatus has found limited application.

SUMMARY OF THE INVENTION

It is a primary object of the present invention to provide a novel concrete vibrating machine for use in vibrating concrete ahead of a concrete finishing machine.

It is a further object of the present invention to provide a novel concrete vibrating machine which overcomes the deficiencies of the prior art concrete vibrator machines.

It is a further object of the present invention to provide a novel vibrating machine which includes concrete vibrating apparatus that may be selectively raised above and lowered into deep slab concrete to clear obstacles in the concrete.

Another object of the present invention is to provide a novel concrete mechanism for preventing the overspeeding of the hydraulic actuated vibrators when the vibrators are fully raised and disengaged from the body of the concrete.

Another object of the present invention is to provide a novel concrete vibrator machine wherein the vibrating apparatus moves through the concrete to be vibrated in a direction laterally of the roadway on which the concrete is being leveled and finished and wherein the concrete vibrating apparatus may be selectively raised from and lowered into the body of the concrete in a novel and expeditious manner thereby clearing obstacles in the roadway.

It is another object of the present invention to provide a novel concrete vibrator machine wherein the selective raising and lowering of the vibrating members is controlled in a novel and expeditious manner.

Still another object of the present invention is to provide a novel concrete vibrator machine which includes at least two hydraulic actuated vibrators mounted in tandem that may be selectively raised and lowered into the concrete body as an integral part of a concrete finishing machine.

It is another object of the present invention to provide a novel concrete vibrating machine which includes at least two hydraulic actuated vibrators mounted in tandem, which may be selectively raised from or lowered into the concrete body in a direction laterally of the roadway being leveled and finished.

The present invention relates to a concrete vibrating apparatus or machine for use in conjunction with a concrete finishing machine which is movable longitudinally along an elongated body of concrete. The concrete finishing machine includes a finishing carriage unit engageable with the surface of the concrete and movable transversely across the body of the concrete. The concrete vibrating apparatus includes a vibrator supporting means mounted to and extending forwardly from the carriage finishing unit, with the vibrator supporting means being movable with the finishing unit transversely across the body of the concrete. Vibrating means is mounted to the vibrator supporting means. The vibrating means includes first and second vibrator units with each respective unit being independently movable between a downwardly position where the unit extends into and below the surface of the concrete and an upwardly position where the unit is above the surface of the concrete. Each of the vibrator units may include a single vibrating member or each may include at least two vibrating members spaced apart and in tandem. Finally, control means is provided for operationally moving either of the vibrator units from the downwardly position where the unit extends into and below the surface of the concrete to the upwardly position where both units are out of contact with the surface of the concrete.

Other and additional objects of the present invention will be apparent from the following description and claims and are illustrated in the accompanying drawings which, by way of illustration, show a preferred embodiment of the present invention and the principles thereof and what we now consider to be the best mode in which we have contemplated applying these principles. Other embodiments of the invention employing the same or equivalent principles may be used and structural changes may be made as desired by those skilled in the art without departing from the present invention and the purview of the appended claims.

DESCRIPTION OF THE EMBODIMENTS

Figure 1:
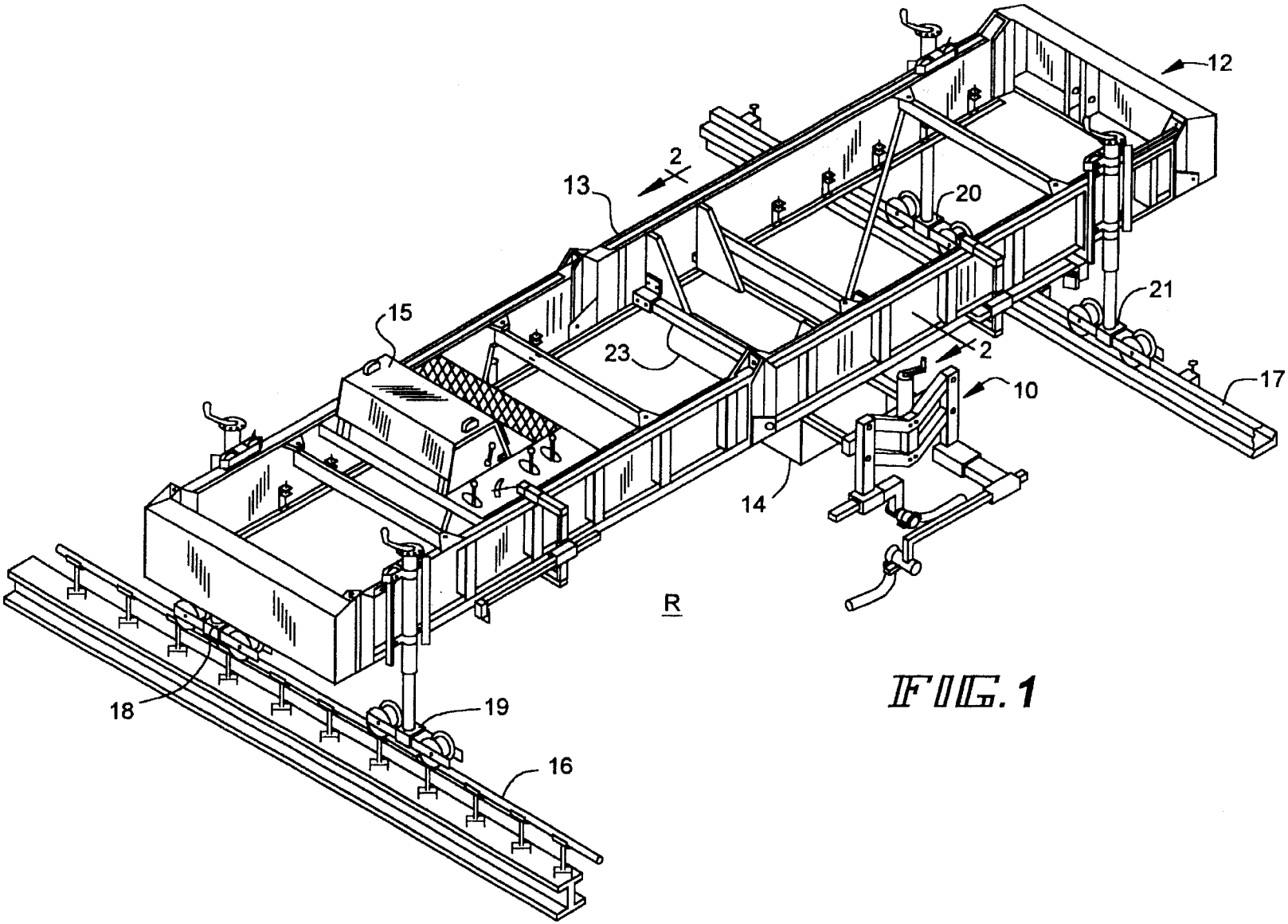
FIG. 1 is a front perspective view of a concrete vibrator machine embodying the principles of the present invention, with the machine embodied in a concrete finishing machine, as an integral part thereof, and disposed in operative position over a roadway.

Referring now to the drawings wherein like numerals have been used throughout the several views to designate the same or similar parts, a concrete vibrator apparatus or machine 10, embodying the principles of the present invention, is shown mounted on and as an integral part of a concrete finishing or leveling machine 12. The leveling machine 12 is shown in FIG. 1 disposed in operative position over a section R of a concrete roadway, street or runway.

Figure 2:
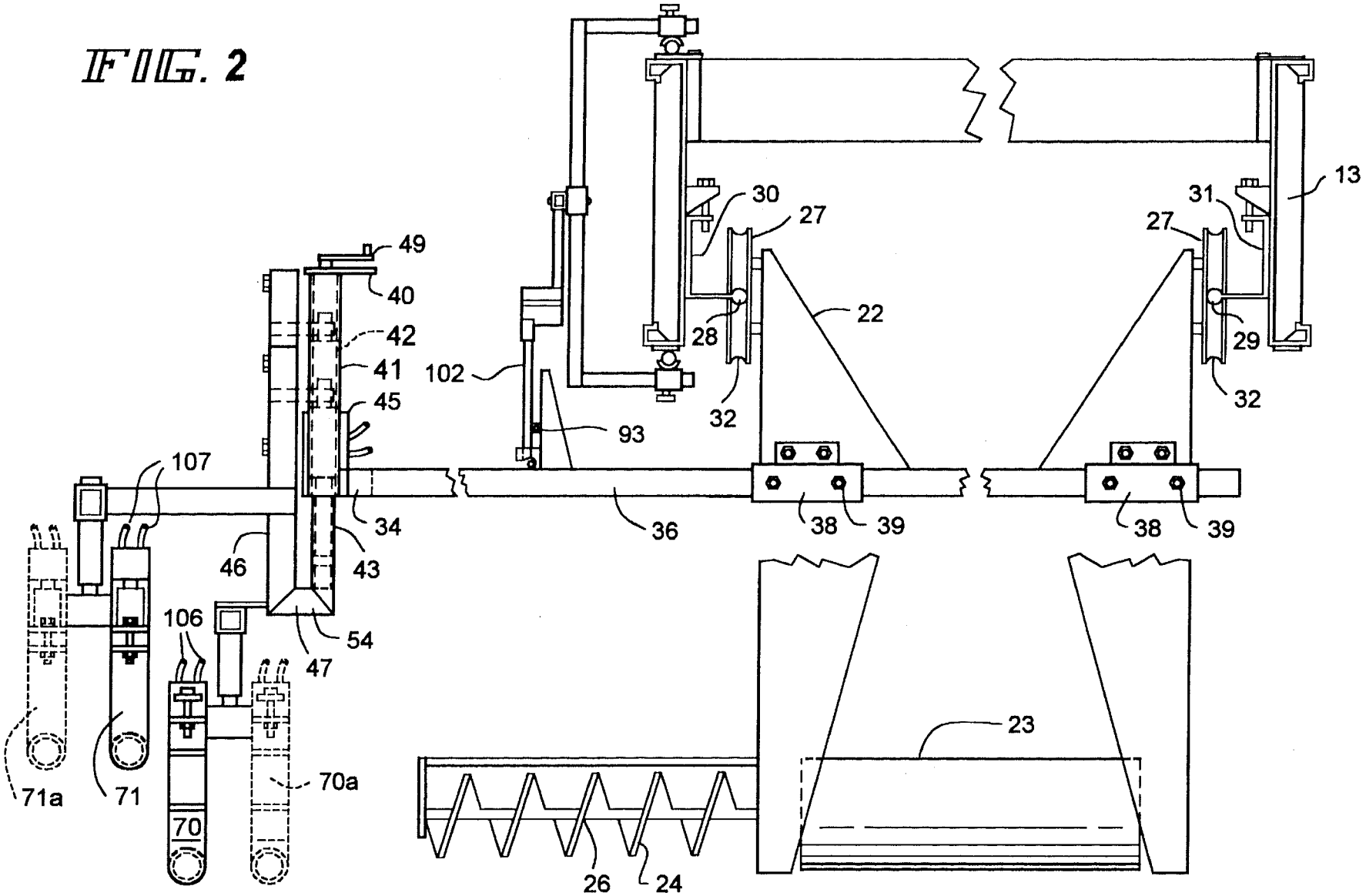
FIG. 2 is a fragmentary sectional view taken substantially along the line 2—2 in FIG. 1.

The concrete leveling machine 12, as shown in FIGS. 1 and 2, is of the type disclosed in U.S. Pat. No. 4,320,987 issued to CMI Corporation, the Assignee of the present invention. As will be appreciated by those skilled in the art, that the depicted leveling machine 12 is merely by way of illustration and not by way of limitation, and the concrete vibrator machine 10 may be used on other suitable types of concrete finishing machines, or as a separate machine, without departing from the purview of the present invention.

The concrete finishing machine 12 includes an elongated trusswork or frame 13 on which is mounted a surfacing unit 14, which is movable longitudinally of the frame 13, with a control console 15 mounted on the frame 13 from which an operator may control operation of the machine 12. The frame 13 is structurally arranged to extend transversely of the roadway 12 being finished, and the machine 12 is adapted to be moved lengthwise of the roadway in a direction transverse to the length of the frame 13.

In the leveling machine 12, shown in FIG. 1, upright, horizontally extending supports 16 and 17 are positioned on opposite sides of the roadway R and extending lengthwise thereof, the upper edges of the supports 16 and 17 being adapted to operatively receive a pair of bogies 18 and 19 and a pair of bogies 20 and 21, respectively, mounted on opposite ends of the frame 13, to enable the frame 13 to be moved along the supports 16 and 17.

Figure 3:
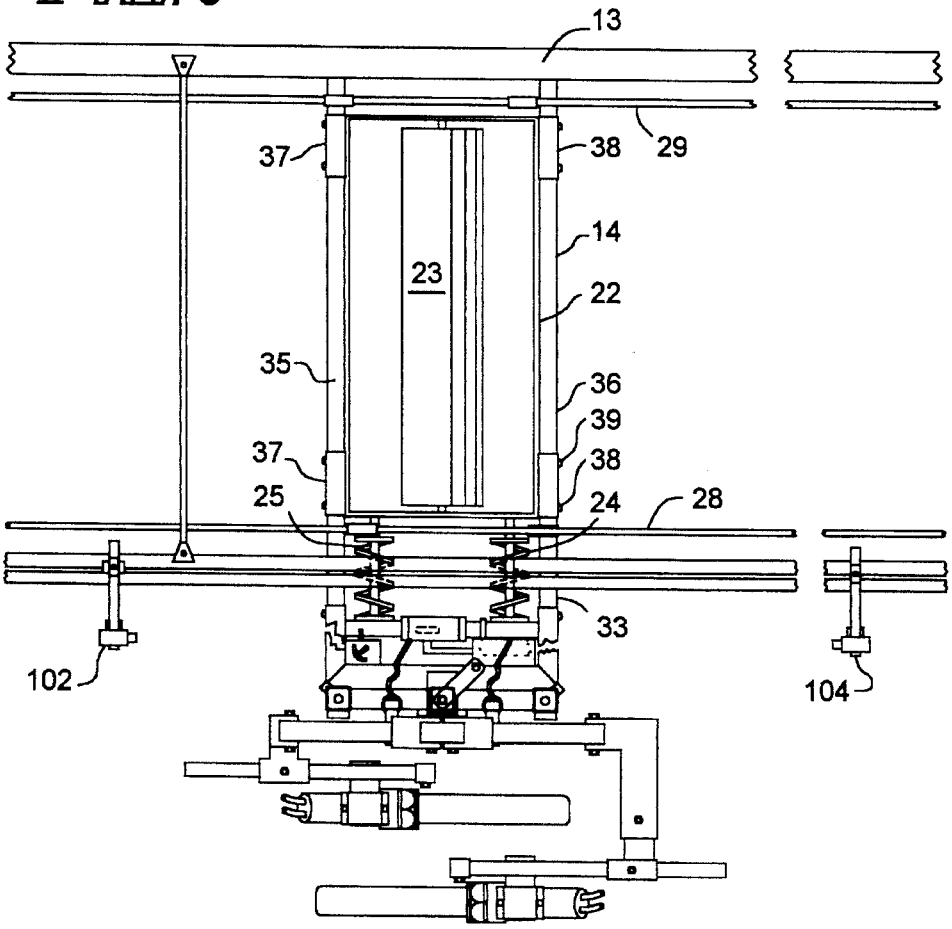
FIG. 3 is a fragmentary top plan view of the machine shown in FIG. 1.

The surfacing unit 14 is mounted on and suspended from the frame 13, as shown in FIGS. 1–3. The surfacing unit 14 includes an elongated carriage 22 having a substantially horizontally extending, elongated concrete-smoothing member in the form of an elongated cylinder 23, journalled in and suspended from the lower portion of the carriage 22, and movable therewith.

Elongated conveyor or screw augers 24 and 25 are disposed forwardly of the front end of the cylinder 23, at opposite sides thereof, in substantially horizontal, uniplanar, spaced relation to each other, as shown in FIG. 3. The helical blades 26 of the conveyor screws 24 and 25 are structurally arranged such that rotation of the screw augers 24 and 25, during operation of the leveling machine 12 is effective to rotate the blades 26 in such direction that the engaged concrete is moved towards the space between the conveyor screws 24 and 25, as well as longitudinally outwardly along the conveyor screws 24 and 25 away from the cylinder 23. Thus, engagement of the conveyor screws 24 and 25 with the concrete material, during movement of the concrete-smoothing member 23 in either transverse direction, is effective not only to move the engaged concrete outwardly longitudinally of the conveyor screws 24 or 25, but is also effective to move the concrete inwardly to a position wherein the two conveyor screws 24 and 25 tend to confine it between them.

The carriage 22 of the surfacing unit 14, FIG. 2, includes two pairs of outwardly projecting, horizontally spaced rollers 27 mounted on respective upper ends thereof in such a position that the rollers 27 are disposed to be supported by and ride along the inner edges of elongated tracks 28 and 29 disposed on opposite sides of the frame 13. The tracks thereby support the surfacing unit 14 for movement longitudinally of the frame 13. The tracks 28 and 29 are supported from the sides of the frame 13 by vertically adjustable hangers 30 and 31, respectively, so that the level of the tracks 28 and 29 at various points along the frame 13 may be adjusted, as desired.

As shown in FIG. 2, a pair of hold down rollers 32 are mounted on each of the ends of the carriage 22 below the respective pair of upper rollers 27. The rollers 32 are positioned such that when the carriage 22 is supported on the tracks 28 and 29, the rollers 32 are in abutting engagement with the lower faces of the adjacent tracks 28 and 29 to hold the rollers 27 downwardly against the tracks 28 and 29.

The operation of the machine 12 is the same as that of the machine shown and described in Rowe et al., U.S. Pat. No. 4,320,987. The machine 12 is intermittently moved longitudinally of the roadway R and on the rails 16 and 17 by suitable drive mechanism, not shown, on the bogies 18–21, and between each such movement of the machine 12 longitudinally of the roadway R, the surfacing unit 14 is moved transversely across the roadway by suitable drive mechanism, not shown. Control of the operation of the leveling machine 12 may be effected both manually and automatically.

The concrete vibrator apparatus or machine 10, as shown in the drawings, is mounted for movement on the surfacing unit 14 in a forwardly projecting relation to the unit. The vibrator apparatus includes a substantially U-shaped support frame 33, FIG. 4, having an elongated end support member 34 positioned forwardly of the carriage 13, and from the opposite ends of which two elongated, substantially parallel legs 35 and 36 project rearwardly under the supporting frame 13 on respective opposite sides of the carriage 22. Each of the legs 35 and 36 is disposed in a respective pair of sleeves 37 and 38 mounted on respective sides of the carriage 22, FIG. 3. The legs 35 and 36 are slidably mounted in the sleeves 37 and 38, respectively, for forward and rearward movement therein relative to the frame 13, for adjusting the forward position of the concrete vibrator machine 10 relative to the concrete finishing machine 12. The legs 35 and 36 may be releasably secured in adjusted position in the respective pair of sleeves 37 and 38 by suitable means, such as fasteners or bolts 39.

Figure 4:
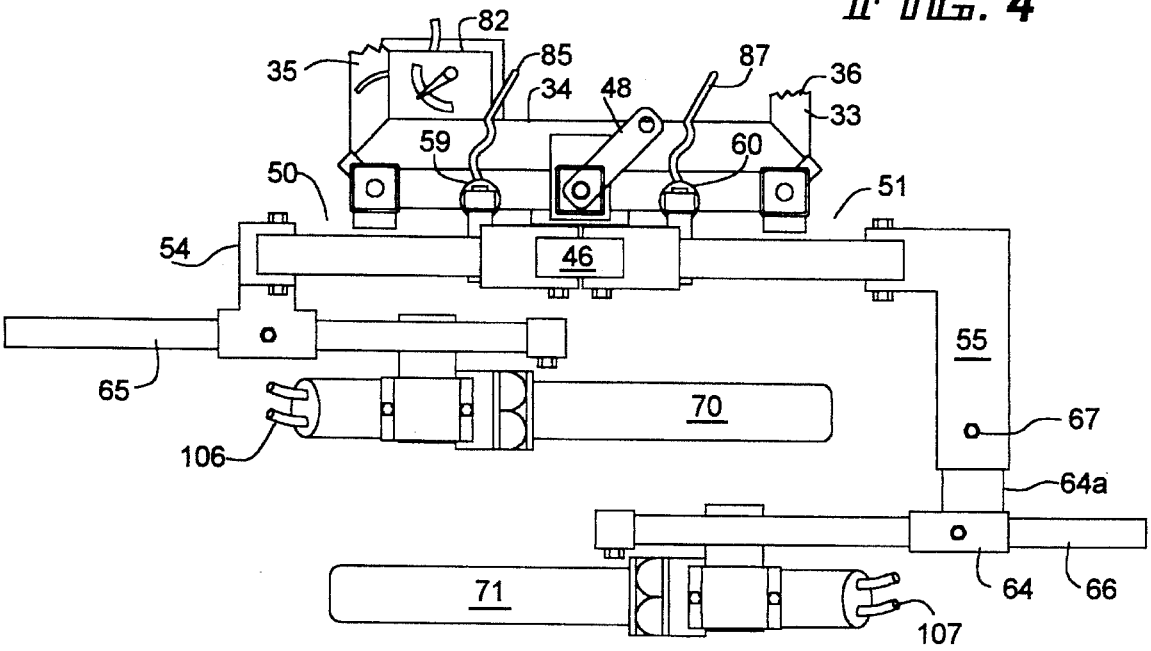
FIG. 4 is an enlarged, fragmentary plan view of a portion of the concrete vibrator machine shown in FIG. 3.

A vertical adjustment mechanism 40 is mounted on the front member 34 of the supporting frame 33, FIGS. 2 and 4, and includes an elongated tubular member 41 having a feed screw 42 threadedly mounted therein, with the lower end of the feed screw 42 rotatably secured, by a connection not shown, to the upper end of leg 43 of a substantially U-shaped member 44, FIG. 2. The tubular member 41 is adjustably secured in a sleeve 45, which is secured substantially intermediately to the end support member 34 of the support frame 33. The U-shaped member 44 includes a main support leg 46, which is disposed in substantially parallel relation to the leg member 43, and is secured to the latter by a connector member 47, as shown in FIG. 2. A hand crank 49 is secured to the upper end portion of the feed screw 42, and rotation of the hand crank 49 is effective to rotate the feed screw 42 in the tubular member 41 to thereby adjust the position of the feed screw 42 and the U-shaped member 44 vertically relative to the tubular member 41 and the leg member 43.

Figure 5:
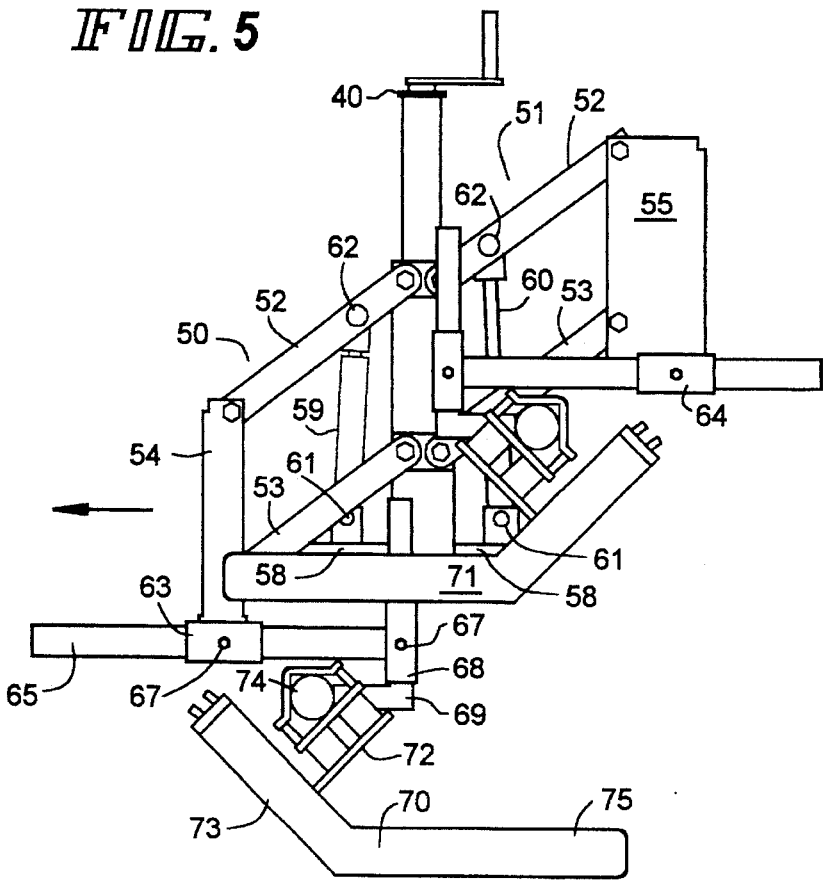
FIG. 5 is a front elevational view of the concrete finishing machine shown in FIG. 4, with parts thereof shown disposed in different operative positions.
Figure 6:
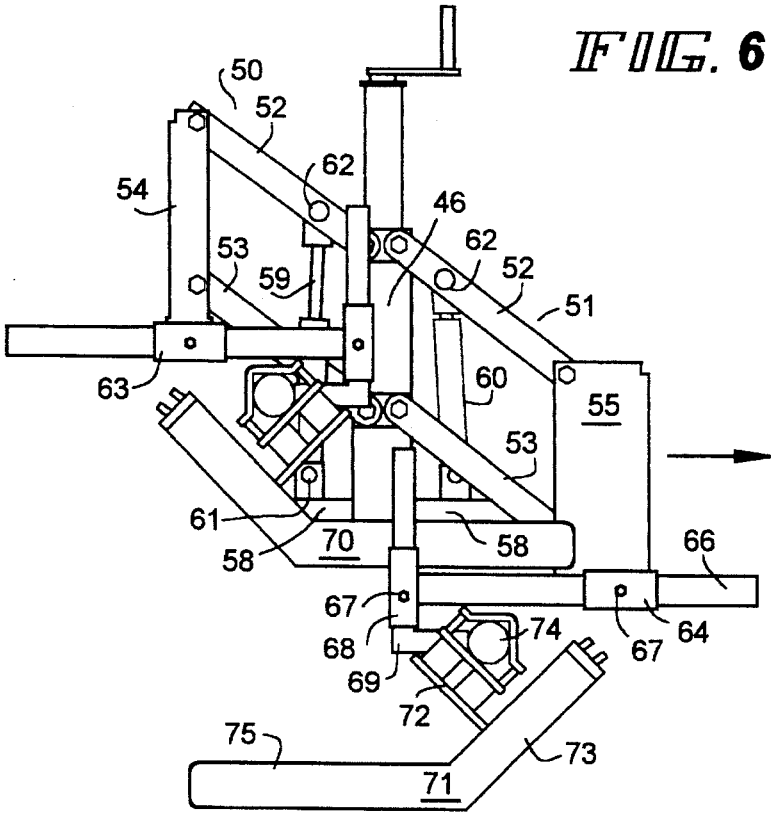
FIG. 6 is a front elevational view of the concrete finishing machine shown in FIG. 4, with parts thereof shown disposed in different operative positions.
Figure 7:
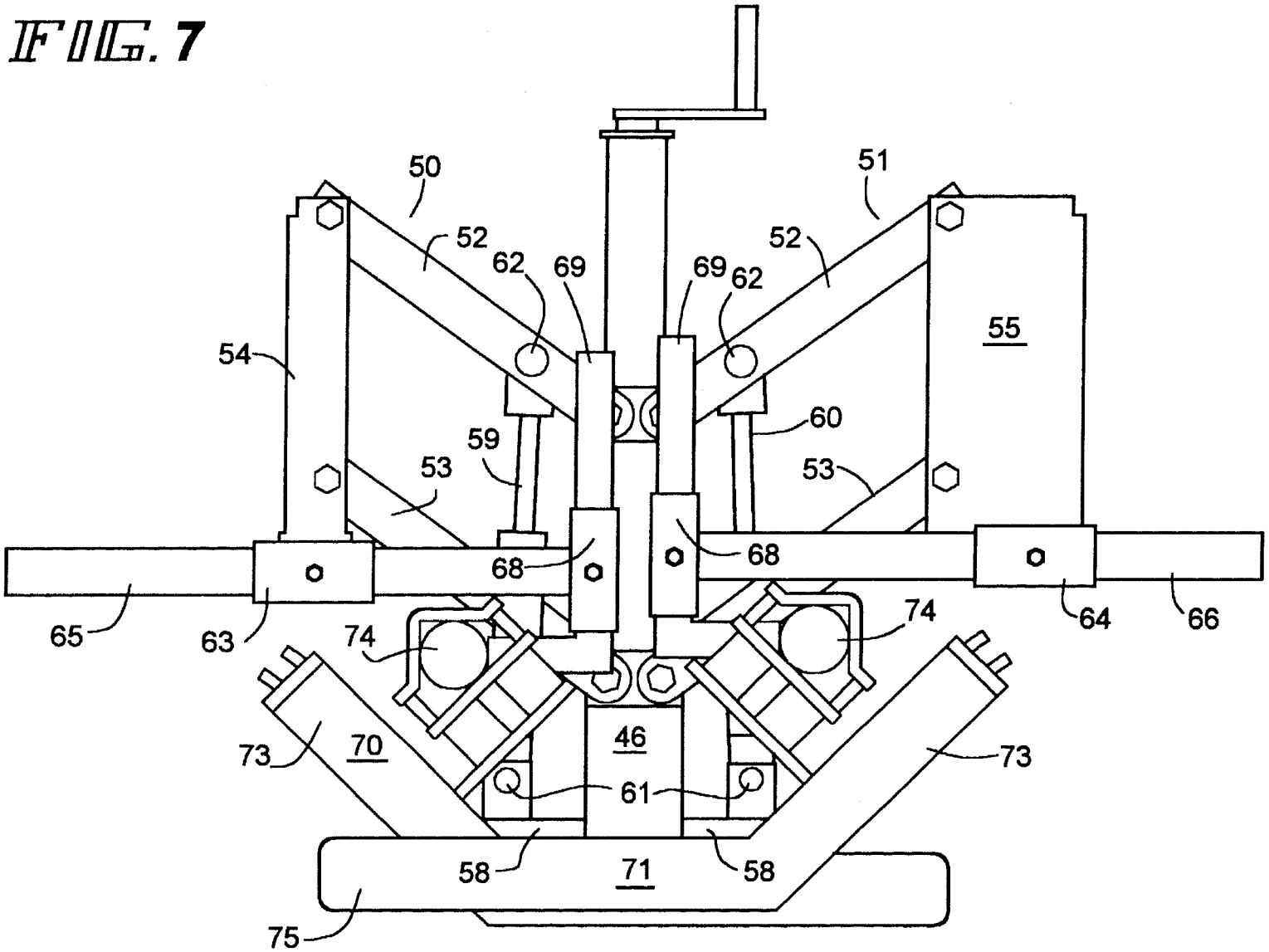
FIG. 7 is a front elevational view of the concrete finishing machine shown in FIG. 4, with parts thereof shown disposed in different operative positions.

The concrete vibrator unit 10 further includes two vibrator supporting frames 50 and 51, each in the form of a parallelogram, FIGS. 5–7. The supporting frames 50 and 51 are each comprised of two elongated, substantially parallel upper and lower bars 52 and 53, respectively, and two oppositely disposed, substantially parallel end bars 54 and 55, connected to respective opposite ends of the bars 52 and 53 by suitable means such as pins or bolts 56. The auxiliary supporting frames 50 and 51 are pivotally secured to the main support leg 46 of the U-shaped member 44 by suitable pins or bolts 57 at the ends of bars 52 and 53 opposite the ends where end bars 54 and 55 are attached thereto. Accordingly, the frames 50 and 51 are adjustable upwardly and downwardly with the leg 46 of the member 44 upon rotation of the hand crank 49.

Mounted to the lower end of main support leg 46 and extending laterally outwardly is a substantially horizontal support member 58 which supports and anchors the lower end of two hydraulic piston-cylinders 59 and 60. The lower end of the hydraulic piston-cylinders 59 and 60 are each mounted to support member 58 by bolts or pins 61 and the upper end of the hydraulic piston cylinders 59 and 60 are each secured to the upper bars 52 by bolts or pins 62.

The lower end portion of the end bars 54 and 55 of the vibrator supporting frames 50 and 51 project downwardly below the lower bar 53, and include elongated sleeves 63 and 64 secured thereto, with the sleeves 63 and 64 disposed in substantially horizontally extending position. Sleeve 64 is, preferably, attached to a perpendicular extending sleeve member 64*a* (FIG. 4) which is adjustably secured by bolts 67 to end bar 55 to permit axial inwardly and outwardly adjustment and location of vibrator frame 51 with respect to vibrator frame 50 (FIG. 4). Two supporting members 65 and 66 are adjustably mounted in and horizontally supported by the sleeves 63 and 64, respectively by bolts 67. Each of the supporting members 65 and 66 includes elongated sleeves 68 positioned on the end thereof in substantially vertically extending position. In both frames 50 and 51, two L-shaped members 69 are adjustably mounted in and vertically supported by sleeves 68 by bolts 67. The position of the L-shaped members 69 laterally of the supporting frames 50 and 51 may be releasably adjusted by adjustably securing sleeve member 64*a* to end bar 55.

Two vibrator members 70 and 71 are adjustably secured to the lower ends of the L-shaped members 69 respectively, FIGS. 5 and 6. The vibrator members 70 and 71 are preferably, hydraulically actuated vibrators having a substantially L-shaped configuration, as shown in FIGS. 5–7.

In the preferred embodiment of the concrete vibrator machine 10 in accordance with the present invention, each of the vibrators 70 and 71 includes a clamp-type mounting bracket member 72 secured to one leg portion 73 of the respective vibrators 70 and 71 which are releasably secured to short lengths of pipes 74 secured to and projecting horizontally from the lower ends of the L-shaped member 69. The leg portions 75 of each of the vibrators 70 and 71 are disposed at an obtuse angle to leg portion 73. Accordingly, by adjusting the position of the mounting bracket member 72 of the vibrators 70 and 71 on the pipes 74, the angle at which the leg portions 75 of the respective vibrators 70 and 71 are disposed relative to the horizontal may be readily adjusted.

When the piston and cylinder member 60 is disposed in the fully extended position, the auxiliary frame 51 is disposed in an upward disengaging position to raise vibrator 71 out of engagement with the body of concrete, as shown in FIG. 5, and the vibrator 70 is in the lowered position because piston and cylinder 59 is in the fully retracted position. When the piston and cylinder member 59 is positioned in its fully extended position, the auxiliary supporting frame 50 and vibrator 70 is raised upwardly out of engagement with the concrete and vibrator 71 is in the lowered position, as shown in FIG. 6. The movement of the vibrators 70 and 71 between the fully raised and the fully lowered positions is effective to dispose them in the desired position relative to concrete to be vibrated and finished.

In the concrete vibrating apparatus in accordance with the present invention each of the vibrator members 70 and 71 may include at least a pair of vibrator members structurally arranged and mounted in parallel and in tandem to the pipes 74 mounted to the L-shaped member legs 69. For example, as shown in the dotted lines in FIG. 2, the vibrators 70 and 71 may each include an additional vibrator 70*a* and 71*a* mounted in parallel alignment onto the L-shaped member legs 69. In this embodiment of the present invention, the individually mounted vibrators preferably should be separated by approximately 12 inches to permit easy raising and lowering of the vibrators from the body of concrete. Also, the increased vibration of the poured concrete ahead of the concrete finishing machine 12 provides for improved and efficient vibration and settling of the body of concrete.

Figure 8:
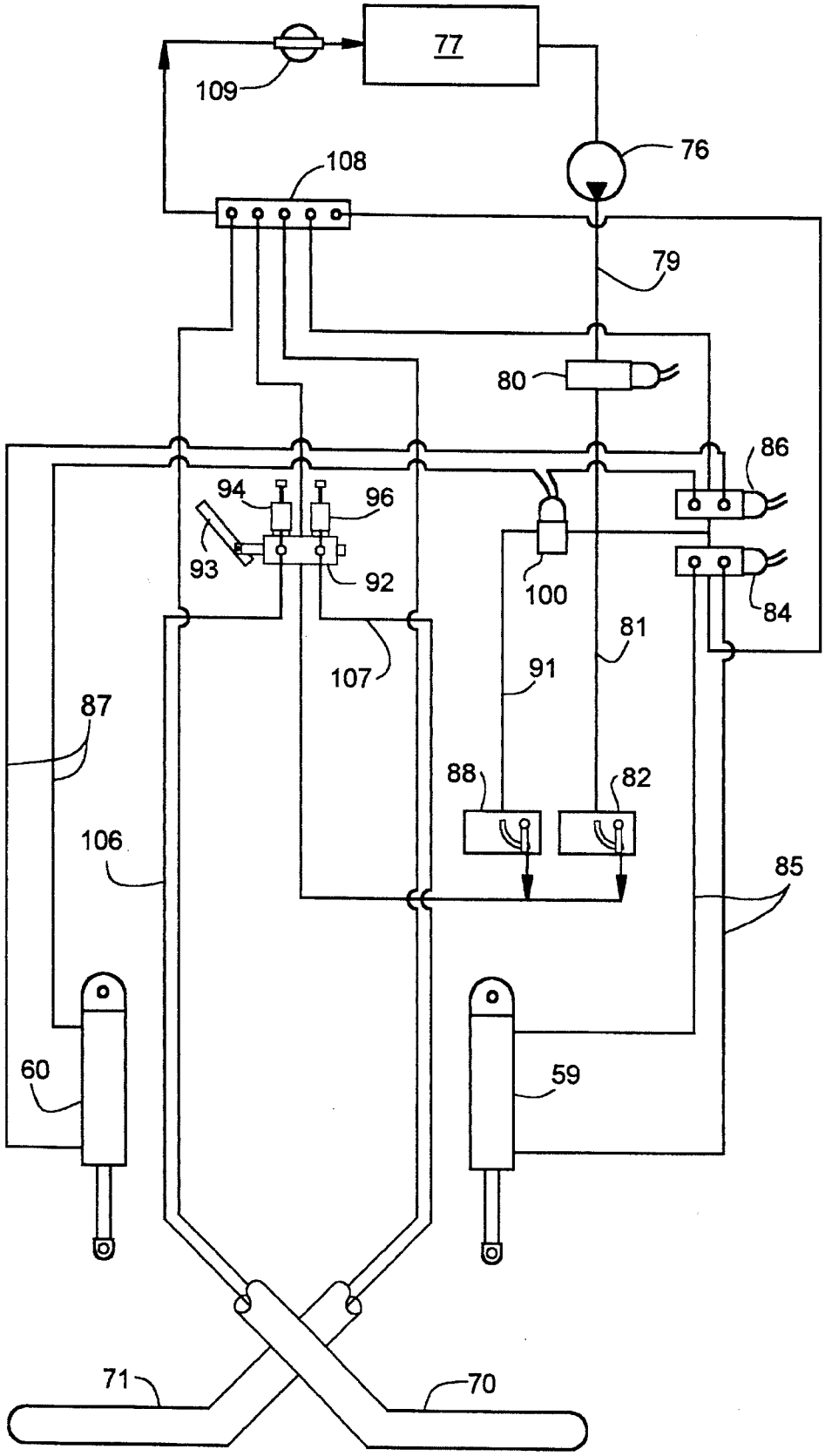
FIG. 8 is a diagram of the hydraulic circuit of the concrete vibrator machine shown in FIG. 1.

The hydraulic cylinders 59 and 60 by which the vibrators 70 and 71 are raised and lowered is operated by reference to the hydraulic circuit diagram for the vibrator system, as shown in FIG. 8. A hydraulic pump 76 provides pressurized hydraulic oil from a reservoir 77 and is connected by a conduit 79 to the inlet side of a solenoid operated vibration speed on/off valve 80. The outlet of the on/off valve 80 is directed through a conduit 81 to the main vibrator speed control valve member 82 which meters the flow rate for most of the hydraulic oil communicating with the vibrators 70 and 71. Hydraulic oil pressure is available to the vibrator speed control valve 82 at all times when the solenoid operated vibration on/off valve 80 is in the open position.

Solenoid operated raising and lowering bidirectional valves 84 and 86 are exposed to hydraulic oil pressure whenever the vibration speed on/off valve 80 is opened. Each of the bidirectional valves 84 and 86 are hydraulically connected by a pair of conduits 85 and 87, respectively, to the piston and cylinders 59 and 60. Thus, when no electrical power is applied to their respective solenoids, bidirectional valves 84 and 86 are normally engaged to permit the flow of hydraulic oil to the respective piston and cylinders 59 and 60 to cause them to expand and fully lift the vibrators 70 and 71, above the concrete surface, as shown in FIG. 7. When electrical power is applied to the bidirectional valve 84, this valve will shift or reverse causing lift piston and cylinder 59 to be fully retracted from the expanded position, thereby causing the vibrator 70 to be fully lowered into the body of the concrete, the position as shown in FIG. 5. In effect, the flow of hydraulic oil or fluid into piston and cylinder 59 is reversed and the cylinder will move from the expanded to the retracted position. Conversely, when electrical power is applied to the solenoid activated bidirectional valve 86, valve 86 will shift resulting in the piston and cylinder 60 moving from the expanded to retracted position, thereby fully lowering vibrator 71 into the body of the concrete. Preferably, valves 84 and 86 are not operable to permit both vibrators 70 and 71 to be in the downward concrete engaging position.

The main vibrator speed control valve 82 meters the flow rate for most of the hydraulic oil communicating with the respective vibrator positioned and operating within the slab of concrete. The hydraulic oil pressure is available to the main vibrator speed control 82 at all times when the vibration speed on/off valve 80 is opened. A minor vibrator speed control valve 88 is provided and meters the remaining portion of the hydraulic oil to the respective vibrator that is engaged in the body of the concrete. The hydraulic oil pressure is available to the minor speed control valve 88 via conduit 91 only when the electrical power is applied to energize the solenoid of the normally closed solenoid operated valve 100.

A reversing valve 92 is provided and is mechanically operated by an actuator arm lever member 93 which is mounted to the top of the carriage unit 22, as shown in FIG. 2. The reversing valve is operatively connected to the vibrator speed control valve 82 and is operable upon the pivotal movement of arm member 93 engaging the stops 102 and 104 as the carriage unit 22 approaches either end of its travel laterally across the roadway R. The actuating lever arm member 93 is engaged by stops 102 and 104 mounted on the frame 13 of the machine 12 thereby shifting the reversing valve 92. The reversing valve 92 operates as a two-position valve and alternately supplies metered hydraulic oil through conduits 106 and 107 to vibrators 70 and 71, respectively. Pressure switches 94 and 96 are hydraulically connected to the respective pressure conduits 106 and 107 directed to vibrators 70 and 71, respectively. Before the actuator arm lever 93 on the carriage unit 22 engages the stop 102 depending downwardly from the frame in the path of travel of arm lever 93, the vibrating machine will have been traveling in the direction of the arrow, as shown in FIG. 5. At the end of this travel direction, the lever 93 engages stop 102 thereby shifting reversing valve 92. The triggering of reversing valve 92 applies electrical power to the bidirectional valve 84 which is shifted or reversed causing the flow of hydraulic oil, through conduit 85 to the piston and cylinder 59 to be reversed. In the same manner bidirectional valve 86 is shifted or reversed causing the flow of hydraulic oil through conduit 87 to the piston and cylinder 60 to be reversed. Thus, piston and cylinder 59 will be moved from the retracted position to the fully extended thereby raising vibrator 70 out of engagement with the concrete while piston and cylinder 60 is fully retracted to thereby lower vibrator 71 into the body of the concrete. Hence, the direction of travel of the machine is now in the direction of the arrow, as shown in FIG. 6. At the end of this travel direction, the carriage unit will cause the arm lever 93 to engage stop 104, extending downwardly from the frame 13. Again, the triggering of reversing valve 92 applies electrical power to the bidirectional valve 84 which is shifted or reversed causing the flow of hydraulic oil, through conduit 85 to the piston and cylinder 59 to be reversed. In the same manner bidirectional valve 86 is shifted or reversed causing the flow of hydraulic oil through conduits 87 to the piston and cylinder 60 to be reversed. Thus, piston and cylinder 60 will be fully extended thereby raising vibrator 71 out of the concrete and vibrator 70 will be lowered into the body of the concrete.

When the reversing valve 92 pressurizes vibrator member 70, the pressure switch 94 applies electrical power to the solenoid operated valve 84 and the solenoid operated valve 100. When the vibrator 70 is pressurized, the vibrator 70 immediately begins to vibrate and the pressure switch 94 applies electrical power to the solenoid of the solenoid operated valve 84 which causes the vibrator 70 be to fully lowered into the body of the concrete and valve 86 is opened thereby causing piston cylinder 60 to be in the fully extended position thereby raising vibrator assembly 51 and vibrator 71 out of engagement with the body of concrete, as shown in FIG. 5.

Alternately, when the reversing valve 92 pressurizes vibrator member 71, the electrical pressure operated switch 96 actuates the solenoid of the solenoid operated valve 86 and the solenoid operated valve 100 which causes the vibrator 71 to vibrate when it is fully lowered into the concrete and the vibrator 70 stops vibrating and is lifted to its fully upright raised position, as shown in FIG. 6.

During the course of paving and leveling concrete with the vibrator apparatus machine 10, it may become momentarily necessary to fully raise either of the vibrators 70 and 71 upwardly out of the concrete to clear an obstacle or box-out in the concrete roadway being paved. The machine operator accomplishes momentarily raising either of the vibrators 70 and 71 from the concrete by manually interrupting the electrical power to both pressure switches 94 and 96 which sense the hydraulic oil pressure directed to piston and cylinder 70 and 71 and which are electrically coupled to bidirectional valves 84 and 86. The triggering of switches 94 and 96 correspondingly shifts either of the bidirectional valves 84 and 86 thereby reversing the hydraulic pressure to the associated piston and cylinder associated with the lowered engaging vibrator to raise the vibrator out of the body of the concrete. Thus, both vibrating vibrators 70 and 71 are in the fully raised position as they continue to vibrate, the view as shown in FIG. 7. When the vibrators 70 and 71 have cleared the obstacle, the machine operator restores the electrical power to the pressure switches 94 and 96; this again lowers one of the vibrators 70 and 71 into the body of the concrete.

When either of the vibrators 70 or 71 are engaged in the concrete and vibrating in the concrete, the engaged vibrator requires considerably more hydraulic oil flow in order to maintain a specific vibrating speed than when either of the vibrators is vibrating in the air. Thus, a vibrator requires considerably more hydraulic oil flow to maintain a specific vibrating speed in the engaged position within the body of the concrete than when the vibrator is vibrating in the air, when in the fully-raised position.

To prevent overspeeding of either vibrator when it is raised out of the concrete and vibrating in air, the hydraulic circuit described in FIG. 9 includes two vibration speed controls, the main vibrator speed control 82 and the minor vibrator speed control 88. The minor vibrator speed control 88 meters hydraulic oil to the vibrator only when the electrical power is applied to the solenoid valve 100. The main vibrator speed control 82 is adjusted by the paving machine operator so that the vibrator is operating at the desired vibration speed while the vibrator is in the body of the concrete. The minor vibrator speed control may be preset so that the disengaged vibrator will not overspeed when the vibrator is raised to its fully upward position and operating in air. Accordingly, the minor vibrator speed control controls the flow hydraulic oil passing through the vibrator members 70 or 71, which ever vibrating member is in the raised position, to thereby maintain the rate of vibration of the raised vibrator member to be approximately equal to the rate of vibration of the vibrator member engaged within the body of the concrete. Because the solenoid valve 100 is energized only when valves 84 and 86 are energized, one of the respective vibrator members 70 and 71 is always in its fully lowered position in the concrete when both the main and minor controls 82 and 88 are in operation. As shown in FIG. 8, a return manifold 108 and a hydraulic oil filter 109 may be provided in the control circuit, as desired.

What has been described is a unique and novel concrete vibrating machine wherein one or more of the vibrators may be fully raised out of the deep slab concrete to clear obstacles, such as box-outs, manhole covers and runway lights.

Additionally, the present invention provides a new and novel hydraulic circuit and control mechanism for operating the concrete vibrating machine which prevents overspeeding of a vibrator when one or both vibrators are fully raised out of engagement with the concrete.

While we have illustrated and described a preferred embodiment of the present invention, it is understood that this invention is capable of variations and modifications; therefore, we do not wish to be limited to the precise detail set forth, but desire to avail ourselves in such changes and alterations that fall within the purview of the following claims.

We claim:

1. A concrete vibrator apparatus for use in conjunction with a concrete finishing machine movable longitudinally along an elongated body of concrete and having a finishing unit engageable with the surface of the concrete and movable transversely back and forth across the body of concrete, comprising:

a supporting means mounted to and extending forwardly and outwardly from the movable finishing unit, and vibrator means mounted to said supporting means, said vibrator means including first and second vibrator units, with each respective first and second vibrator units being independently movable between a downwardly position wherein said unit extends into and below the surface of the concrete and an upwardly position wherein said unit is out of contact with the surface of the concrete.

2. A concrete vibrator apparatus in accordance with claim 1, wherein said supporting means includes a pair of supporting frames, each of said supporting frames structurally arranged to receive and mount one of said first and second vibrator units and being independently movable with respect to one another.

3. A concrete vibrator apparatus in accordance with claim 1 further including first vibrator control means communicating with said vibrator means for vibrating said vibrator means.

4. A concrete vibrator apparatus in accordance with claim 1 further including first control means communicating with said supporting means for predeterminely moving both of said first and second vibrator units between said downward concrete engaging position and said upward disengaging position.

5. A concrete vibrator apparatus in accordance with claim 1, wherein each of said first and second vibrator units includes at least an elongated vibrator member.

6. A concrete vibrator in accordance with claim 1, wherein each of said first and second vibrator units is comprised of two elongated vibrator members spaced apart from each other.

7. A concrete vibrator apparatus in accordance with claim 3, further including second vibrator control means communicating with said vibrator means for predeterminely controlling the rate of vibration of the respective first and second vibrator units when said vibrator unit is in the upward position out of contact with the surface of the concrete.

8. A concrete vibrator apparatus in accordance with claim 2, wherein each of said supporting frames are hydraulically actuated and wherein each of said supporting frames are independently movable between the downwardly position and the upwardly position by means of a hydraulically actuated piston-cylinder member.

9. A concrete vibrator apparatus in accordance with claim 6, wherein said spacing between said two elongated vibrator members is about 12 inches.

10. A concrete machine in accordance with claim 3 further including second vibrator control means communicating with the respective first or second vibrator units to control and maintain substantially the same rate of vibration of the respective units extending below the surface of the concrete and out of contact with the surface of the concrete.

11. A concrete vibrator apparatus in accordance with claim 2 wherein each of said supporting frames includes a support member, and each of said supporting frames are in the form of a parallelogram, with one end of each of said supporting frames being pivotally secured to said support member.

* * * * *

UNITED STATES PATENT AND TRADEMARK OFFICE

CERTIFICATE OF CORRECTION

PATENT NO. : 5,492,432

DATED : February 20, 1996

INVENTOR(S) : Larry G. Eben, et. al.

It is certified that error appears in the above-indentified patent and that said Letters Patent is hereby corrected as shown below:

Column 10, lines 10 and 29, after "vibrator" insert --apparatus--.
Delete "machine" insert -- vibrator apparatus--.

Signed and Sealed this

Second Day of July, 1996

*Attest:*

*Attesting Officer*

BRUCE LEHMAN

*Commissioner of Patents and Trademarks*